US006084621A

United States Patent [19]

Shioya

[11] Patent Number: 6,084,621

[45] **Date of Patent: *Jul. 4, 2000**

[54] INK JET PRINTING METHOD AND INK JET PRINTING APPARATUS

[75] Inventor: Makoto Shioya, Tokyo, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/821,734

[22] Filed: Mar. 20, 1997

[30] Foreign Application Priority Data

Mar. 26, 1996 [JP] Japan ..... 8-070231

[51] Int. Cl.[7] ..... B41J 2/01

[52] U.S. Cl. ..... 347/101; 347/96; 347/98; 283/96; 283/97; 503/206

[58] Field of Search ..... 347/96, 98, 101; 503/206; 428/29; 283/72, 96, 97; 399/366

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,538,160 | 8/1985 | Uchiyama | 347/101 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 5,549,740 | 8/1996 | Takahashi et al. | 106/20 R |
| 5,623,294 | 4/1997 | Takizawa et al. | 347/98 |

FOREIGN PATENT DOCUMENTS

| | | |
|---|---|---|
| 54-56847 | 5/1979 | Japan . |
| 59-123670 | 7/1984 | Japan . |
| 59-138461 | 8/1984 | Japan . |
| 60-71260 | 4/1985 | Japan . |

*Primary Examiner*—John Barlow
*Assistant Examiner*—Christina Annick
*Attorney, Agent, or Firm*—Fitzpatrick, Cella, Harper & Scinto

[57] ABSTRACT

A latent image is formed by applying a colorless liquid that makes colorants of ink insoluble to a predetermined area of a print material. The latent image is made visible by applying ink to only the predetermined area of the print material to cause reaction between the ink and the colorless liquid to make the colorants of the ink insoluble and thereby fix the colorants in the print material. Another method of making a latent image visible involves applying ink to the entire surface of the print material and washing the print material with water to remove unfixed ink.

14 Claims, 8 Drawing Sheets

INK JET PRINTING METHOD AND INK JET PRINTING APPARATUS

BACKGROUND OF THE INVENTION

1. Field of the Invention

The present invention relates to an ink jet printing method and an ink jet printing apparatus, which form an image by forming a latent image with a colorless liquid and then making the latent image visible. This invention also relates to a recorded medium obtained from the above printing method and the printing apparatus, the recorded medium having the latent image.

2. Description of the Prior Art

In Japan a picture drawn in invisible ink which is later heated to make it visible has been known since long ago.

This kind of hidden picture is generally formed by drawing letters or pictures as a latent image on paper with a juice of citrus fruits and is made visible by heating the paper to turn the latent image to brown or black.

Such a conventional technique of turning a hidden picture to a visible form, or "aburidashi" as it is called in Japanese, is made possible because of the presence in the fruit juice of organic acid as a substance that develops color upon heating.

In realizing the conventional technique of "aburidashi" with the ink jet printing system, the following problems may be encountered.

(1) Ink used needs to contain organic acids, the substances that produce color. The organic acids in the ink, however, can attack ink tanks and head members. Hence, the use of organic acids is not desirable.

(2) Particularly when a so-called bubble jet system that employs an electrothermal transducer as an ejection energy generating element to cause film boiling to produce energy for ejecting ink is used to eject organic acid-laden ink for forming a latent image, there is a possibility of the organic acids scorching on a heater as the electrothermal transducer, which prevents heat of the electrothermal transducer from being transmitted to the ink efficiently, leading to unstable ejection of ink droplets usually called, "kogation problem".

(3) In addition to heads and ink tanks containing ordinary ink, the user must purchase other heads and ink tanks dedicated for the organic acid-laden ink. This will increase the running cost.

(4) The conventional technique of making a latent image visible requires heating. When, however, a print material on which a latent image is formed is flammable, the possibility of the print material catching fire cannot be ruled out and a problem remains in terms of safety.

There is also known a method that does not require heating to make a latent image visible. This method produces color by combining an acid substance or alkaline substance and a pH indicator such as litmus solution and phenolphthalein.

When this method is implemented with the ink jet system, however, the user needs to buy ink tanks containing the above chemical agents and associated heads in addition to the ordinary ink tanks. This will also raise the running cost.

Further, when this method is implemented with the bubble jet system, kogation caused by the chemical agents on the heater may depend on the kind of the agent, making it difficult for heat energy from the heater to be transmitted to the ink efficiently, which in turn leads to unstable ejection of ink.

As described above, in implementing these conventional color development techniques with the ink jet system or the bubble jet system, it is necessary to purchase special parts or components for forming a latent image and producing color and this increases the cost, which of course is not desirable for the user. With the bubble jet system, it is difficult to overcome the kogation problem with the heater.

The present invention has been accomplished to overcome the above-mentioned problems and provide an ink jet printing method and an apparatus for implementing the method, which perform printing by using ink for producing colors and an almost colorless liquid containing a processing liquid that makes colorant of ink insoluble or coagulate. More particularly, it is the object of this invention to provide an ink jet printing method and an ink jet printing apparatus, which employ a new color producing method or an image forming method—somewhat similar to the conventional latent image recovering technique—which involves first applying the colorless liquid to the recording paper to form a latent image and then applying the color ink to make the latent image visible.

Further, the present invention provides a recorded medium formed with a latent image of only the colorless liquid in a specified area thereof.

SUMMARY OF THE INVENTION

The above objectives are achieved by the following aspects of this invention.

A first aspect of this invention is an ink jet printing method which comprises the steps of: applying to a print material an almost colorless liquid containing a substance that makes colorant of ink insoluble or coagulate to form a latent image on the print material; applying the ink to at least a part of the latent image formed on the print material; and removing only that part of the ink applied in the ink application step to the print material which is not insoluble or coagulated and is other than ink made insoluble or to coagulate by the latent image forming liquid and thereby making the latent image visible on the print material.

Here, a ratio of an optical density $OD_1$ of an area where the latent image is made visible to an optical density $OD_2$ of an area removed of ink not made insoluble or to coagulate satisfies the following expression:

$2 \leqq OD_1:OD_2$, or $3 \leqq OD_1:OD_2$.

The ink removing step may be performed by exposing the printed material to running water or standing water or by wiping the printed material of the ink.

The application of the liquid or the ink is performed by an ink jet type ejection means. In this case, the ejection means may include an ejection energy generating element to produce energy to eject the liquid or the ink. Further, the ejection energy generating element may be an electrothermal transducer to generate thermal energy to cause film boiling in the liquid or the ink.

Further, the liquid may include low molecular weight cation substances and high molecular weight cation substances, and the ink may include anion dyes. It is also possible that the liquid may include low molecular weight cation substances and high molecular weight cation substances, and the ink may include at least anion compounds and pigments.

A second aspect of this invention is an ink jet printing method which comprises the steps of: when a print material is applied with an almost colorless liquid containing a substance that makes colorant of ink insoluble or coagulate, demarcating with a color ink an area of the print material that is applied with the liquid; and removing from the print material only that part of the ink which is not insoluble or coagulated and is other than ink made insoluble or to coagulate by the liquid applied to the liquid application area of the print material, to make visible a latent image corresponding to the liquid application area.

Here, the color ink application step may be performed before the liquid application step.

In this case, too, the liquid may include low molecular weight cation substances and high molecular weight cation substances, and the ink may include anion dyes. It is also possible for the liquid to include low molecular weight cation substances and high molecular weight cation substances and for the ink to include at least anion compounds and pigments.

Further, a third aspect of this invention is an ink jet printing apparatus which comprises: a means for applying ink and an almost colorless liquid to a print material, the liquid containing a substance to make colorants of the ink insoluble or coagulate; and an ejection control means for selecting between a mode to eject only the liquid from the application means and a mode to eject only the ink from the application means.

Here, the application means may have an ejection energy generating element to produce energy to eject the liquid or the ink. The ejection energy generating element may be an electrothermal transducer to generate thermal energy to cause film boiling in the liquid and the ink.

A fourth aspect of this invention is an ink jet printing apparatus which comprises: a mode of forming a latent image of only an almost colorless liquid in a predetermined area of a print material by ejecting the liquid onto the print material according to image signals, the liquid containing a substance to make colorants of ink insoluble or coagulate; and a mode of ejecting the ink onto almost entire surface of the predetermined area of the print material.

Further, a fifth aspect of this invention is a recorded medium which comprises: a print material; and a latent image formed of only an almost colorless liquid in a predetermined area on the print material, the liquid containing a substance to make colorants of ink insoluble or coagulate.

With this invention, recording a normally colored image on a print material can be done by applying the colorless liquid to the image area before or after, or before and after the ink application step to produce a recorded image with high water resistance. This invention also readily allows the user to perform recording or printing later to make visible a latent image that was recorded colorless, in a manner somewhat similar to the conventional latent image recovering technique of "aburidashi." In this case, however, the user does not need to buy additional ink and heads dedicated for such a particular use and can readily enjoy making hidden messages or pictures visible with the ink jet system. Further, because the color ink and the colorless liquid that are used in ordinary recording are used, there is no risk of ink or liquid being scorched on the heater.

If a printing apparatus is used that can mount heads for delivering a plurality of color inks, there is an advantage that the user can choose from them a desired color with which to make the latent image visible.

Further, a recorded medium having a latent image formed of only a colorless liquid can be handled alone. Applying an ink to the latent image area of the recorded medium causes the liquid components of the latent image to react with the ink, fixing the ink in that area. As a result, the latent image becomes visible. When the ink is ejected not just over the latent image area but over the entire surface of the recorded medium, the part of the unfixed ink that rests on other than the latent image area and is not made insoluble or not to coagulate by the colorless liquid can be washed away with water.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, preferred embodiments of this invention will be described by referring to the accompanying drawings.

(Embodiment 1)

Figure 1:
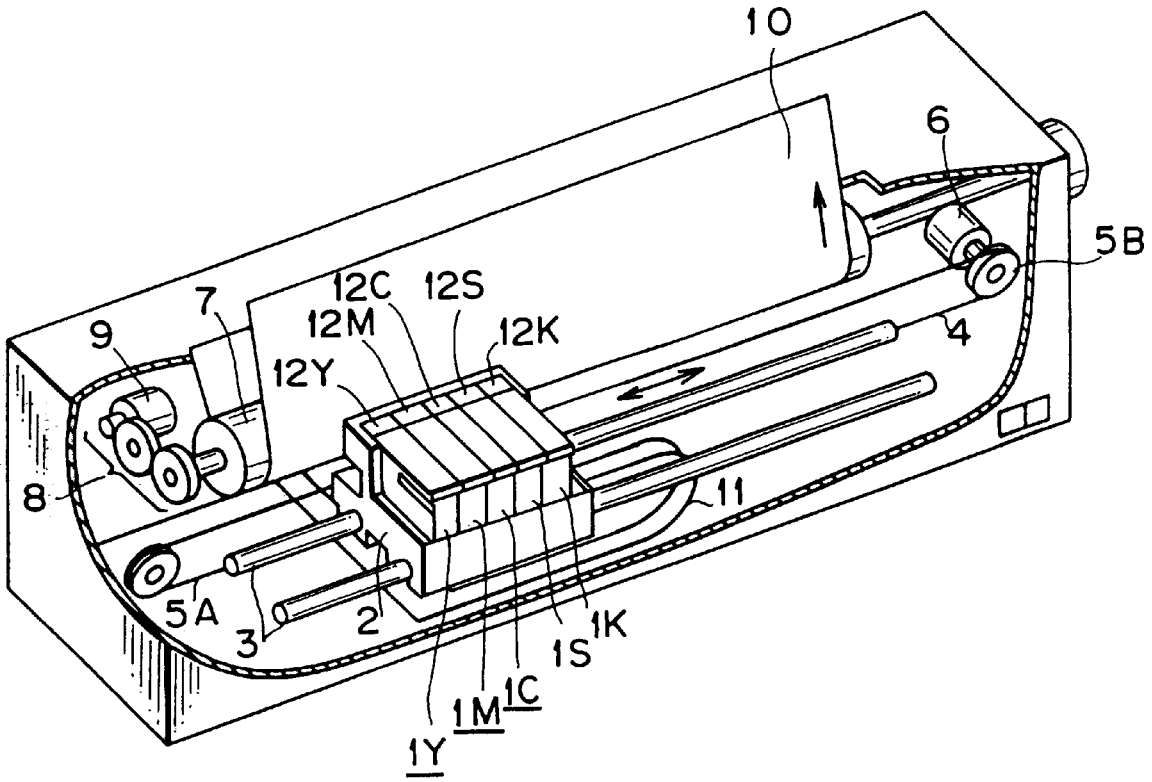
FIG. 1 is a schematic perspective view showing one embodiment of an ink jet printing apparatus according to the present invention.

FIG. 1 is a schematic perspective view showing essential portions of a first embodiment of the ink jet printing apparatus according to the present invention. The following embodiments use a processing liquid described later, which is almost colorless and contains a substance that makes ink colorants insoluble or coagulate.

In FIG. 1, mounted on a carriage 2 are ink jet units 1Y, 1M, 1C, 1K, 1S, which have heads 12Y, 12M, 12C, 12K, 12S for ejecting yellow (Y), magenta (M), cyan (C) and black (K) inks and a processing liquid (S) and tanks containing these color inks and processing liquid, respectively. Each of these heads has, for example, 32 nozzles aligned at intervals of 62.5 $\mu$m in a direction as a sub-scan direction that recording paper 10 as a print material is fed. Ink passages connected to the individual nozzles are each provided with a heater to generate thermal energy for ejecting ink. The heaters generates heat in response to electric pulses applied according to drive data, and the heat causes film boiling in the ink, which creates an air bubble to force a droplet of ink or processing liquid out of each nozzle.

The carriage 2 carries the heads 12Y, 12M, 12C, 12K, 12S and the tanks in such a way that they can be removed. The carriage 2 moves along two guide shafts 3 which slidably engage a part of the carriage 2. The carriage 2 is moved by a belt 4 to which the carriage 2 is attached and which is wound around pulleys 5A, 5B and driven by a motor 6. A flexible cable 11 is connected to each of the heads to feed to a head driver installed in each head ejection signals and control signals generated according to print data by a host device or a controller of this apparatus.

A platen roller 7 extends longitudinally parallel to the guide shafts 3 and is rotated by a paper feed motor 9 to feed recording paper 10 as a recording medium and defines a recording flat surface on the recording paper 10.

In the above construction, the head of each ink jet unit ejects ink onto a recording area of the recording paper 10, i.e., the area opposing the nozzles of the heads, thus printing on the recording paper 10.

Figure 2:
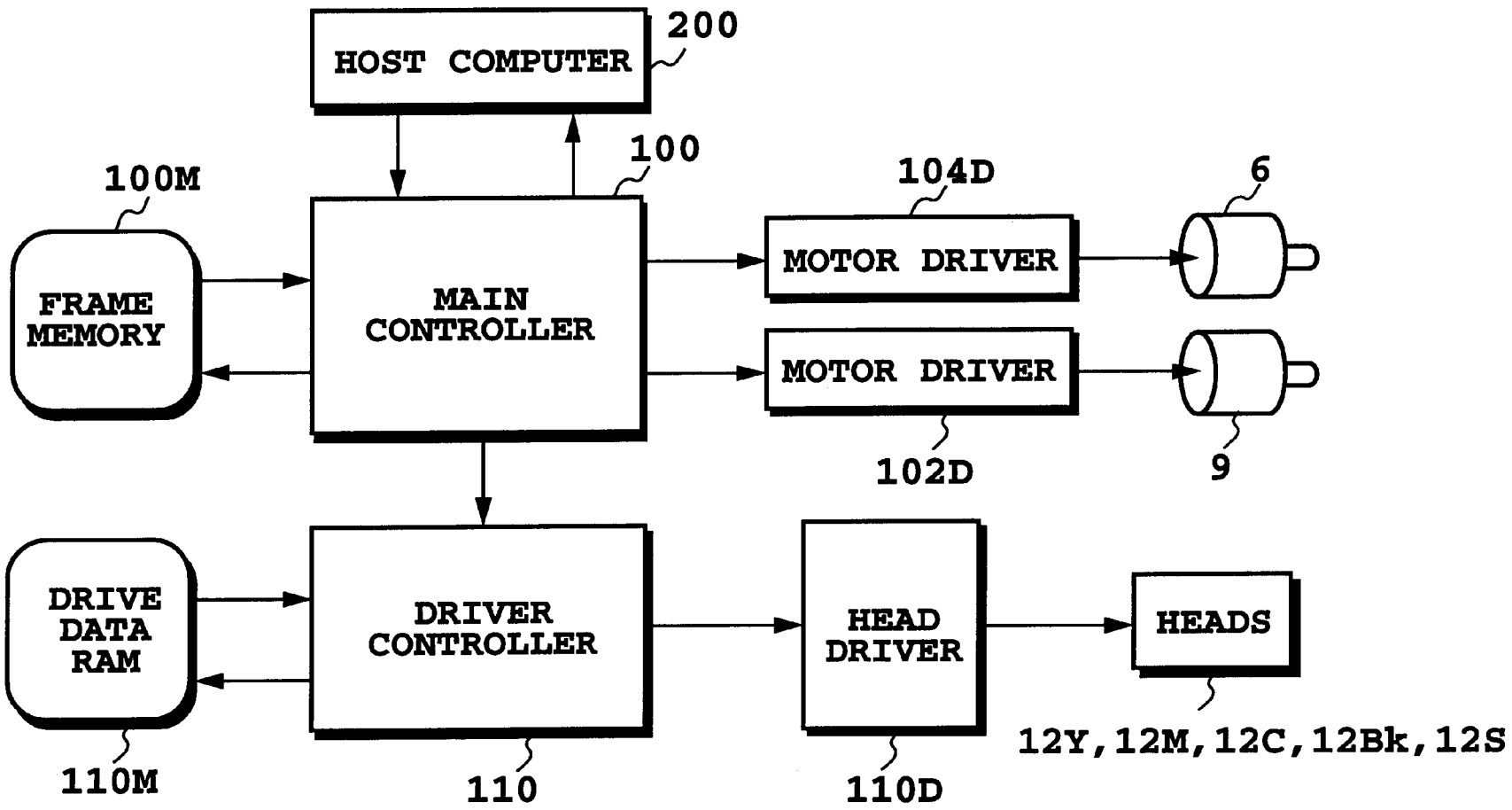
FIG. 2 is a block diagram showing a control configuration of the ink jet printing apparatus of FIG. 1.

FIG. 2 is a block diagram showing a control configuration of the ink jet printing apparatus shown in FIG. 1.

A main controller 100 includes a CPU and converts image data sent from a host computer 200 into pixel data assigned with gray scale data, which is then stored in a frame memory 100M. The main controller 100 feeds data of each pixel stored in the frame memory 100M to a driver controller 110 at a predetermined timing. The driver controller 110 converts the pixel data supplied into ejection data (representing on/off of the heater in each head 1) that corresponds to a nozzle number (representing which nozzle of the recording head 1 is to be activated) and a scan number (representing where the current scan is in the order of the main scans) and stores the converted ejection data in the drive data RAM 110M. The driver controller 110, in response to the control signal from the main controller 100, reads the drive data stored in the drive data RAM 110M by referencing the nozzle number and the scan number, feeds the drive data to the head driver 110D and at the same time controls the timing of activating the head driver 110D.

In the above configuration, the main controller 100 controls the ejection by the heads 12Y, 12M, 12C, 12K, 12S of inks and processing liquid and the rotation of the carriage motor 6 and paper feed motor 9 through the driver controller 110 and motor drivers 104D and 102D. Thus, the recording paper 10 is printed with characters and images according to the image data.

While in the above configuration the driver controller 110 converts the gray scale data into the ejection data, this operation may be done by the main controller 100. In that case, the ejection data can be stored in the frame memory 100M, allowing the drive data RAM 110M to be eliminated.

Next, one embodiment of the ink jet printing method of this invention using the ink jet printing apparatus of the above configuration will be explained.

The recording procedure in this embodiment follows.

First, let us take an example case where a user selects a colorless recording mode as a latent image forming mode. The selection of the colorless recording mode can be made by specifying a desired menu or command from the host computer 200 or by selecting an appropriate switch/menu of the printing apparatus.

Next, image data is sent from the computer as image signals, according to which the apparatus ejects only the processing liquid to form a latent image in a predetermined area on the recording paper 10.

In this way, the user can produce a recorded material (recorded medium), the recording paper 10 having a latent image formed of only the processing liquid on a specified area. This recorded medium has apparently no images or letters written thereon, but the latent image can easily be made visible by applying inks to only a predetermined area or the entire area of the recorded medium in an image recovering mode described later. This process may be performed immediately after the latent image-recorded medium was produced or some other day or by other person.

When forming a latent image, the area of the latent image may be demarcated with a color ink.

Inks and processing liquid used are as follows.

<Composition of the Processing Liquid>

| | |
|---|---|
| PAA-HC1-3L (produced by Nitto Boseki Co., Ltd.) | 5.0% by weight |
| Cation G50 (produced by Sanyo Kasei Co., Ltd.) | 0.3% by weight |
| Diethylene glycol | 10.0% by weight |
| Lithium acetate | 0.5% by weight |
| Water | 84.2% by weight |
| <Composition of the inks> | |
| Glycerine | 7.5% by weight |
| Thiodiglycol | 7.5% by weight |
| Urea | 7.5% by weight |
| Dye | 3.5% by weight |
| Y C. I. direct yellow 142 | |
| M C. I. acid red 289 | |
| C C. I. direct blue 199 | |
| Bk C. I. food black 2 | |
| Acetylenol EH (produced by Kawaken Fine Chemical Co., Ltd.) | 1.0% by weight |
| Water | 73.0% by weight |

Next, the procedure of the image recovering mode to be performed on the recorded medium having a latent image of only the colorless processing liquid is described below.

The user sets the latent image-recorded medium on the platen roller 7 of the printing apparatus and chooses the image recovering mode.

The selection of this image recovering mode is made by the host computer 200 or by appropriate setting of the printing apparatus as in the selection of the colorless recording mode as the latent image forming mode. In the image recovering mode, the user can specify colors that he or she wants to make visible by selecting inks and ink ejection areas. Colors that can be made visible include not only primary colors but also secondary and tertiary colors.

Areas where images are made visible need not have a uniform color but may have a pattern consisting of a plurality of colors.

It is also possible for the user to render a latent image visible by ejecting inks in a pattern created by the user himself. The recording area as an ink-ejecting area where the inks are applied may be an entire area or parts of the print material.

If an area formed with a latent image is marked with a color ink during the process of forming the latent image, it is possible to limit the amounts of inks used in the marked area by specifying the area to the printing apparatus.

After the recording is finished, the user exposes the recorded medium to, for example, running water for about one minute. For the color inks on area other than the area where the inks are fixed by the processing liquid, their colorants are not made insoluble or to coagulate by the processing liquid and are not fixed on the surface of the recording medium, so they can be washed away. With the unfixed color inks washed away, only the color inks fixed by the colorless processing liquid in the latent image forming regions remain, revealing a hidden image.

Washing may be done by other than running water, such as by dipping in standing water or wiping with wet cloth or paper.

Because the hidden image is revealed more clearly by thoroughly washing away color inks that are not fixed by the processing liquid, the water resistance of color inks on the print material should preferably be low.

It is also desired that the ratio of an optical density $OD_1$ of the revealed image portion to an optical density $OD_2$ of the washed-away portion be 2 or more, preferably 3 or more and more preferably 4 or more.

Figure 3:
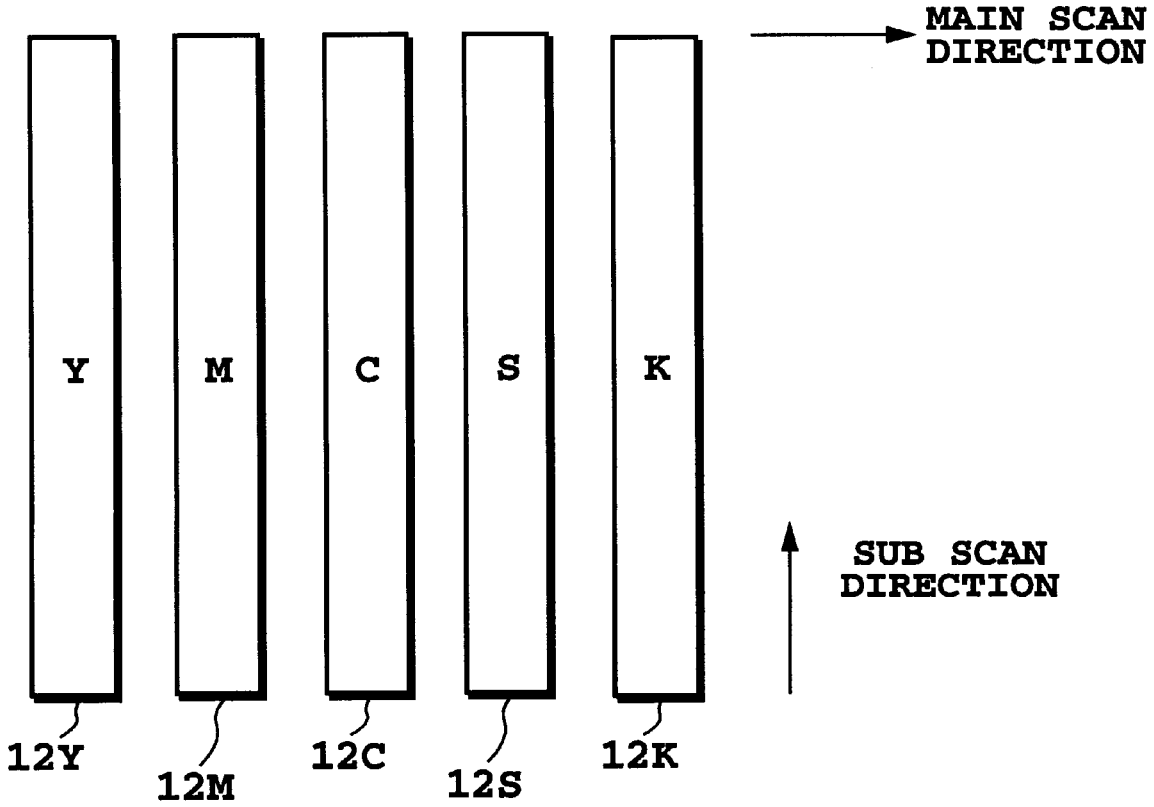
FIG. 3 is a plan view showing an example arrangement of ink jet print heads with different colors installed in the ink jet printing apparatus of FIG. 1.

In the ink jet printing apparatus of FIG. 1 suitably applied in this embodiment, the ink jet print heads 12Y, 12M, 12C, 12S, 12K are arranged in the main scan as shown in FIG. 3. The heads are independent of each other and have a plurality of nozzles for inks or processing liquid aligned in the paper feed direction (sub-scan direction).

Figure 4:
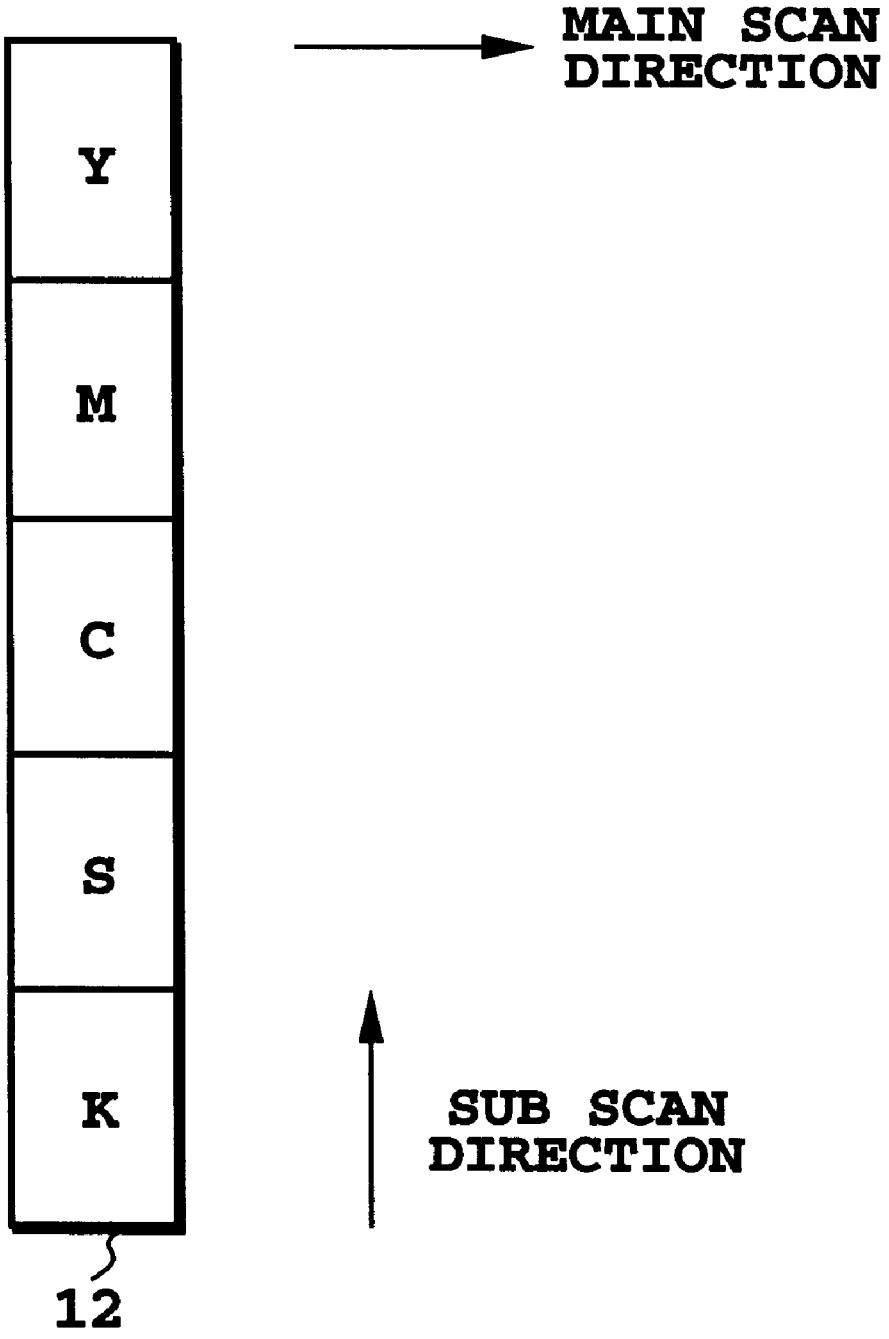
FIG. 4 is a plan view showing another example of arrangement of the ink jet print heads with different colors installed in the ink jet printing apparatus of FIG. 1.

This invention may also use the heads 12 as shown in FIG. 4. All of these heads 12 have their nozzles for different colors arranged in a single line. The heads shown in FIG. 4 are shorter in width than the heads of FIG. 3 and can suitably be mounted on a compact printing apparatus.

Figure 5:
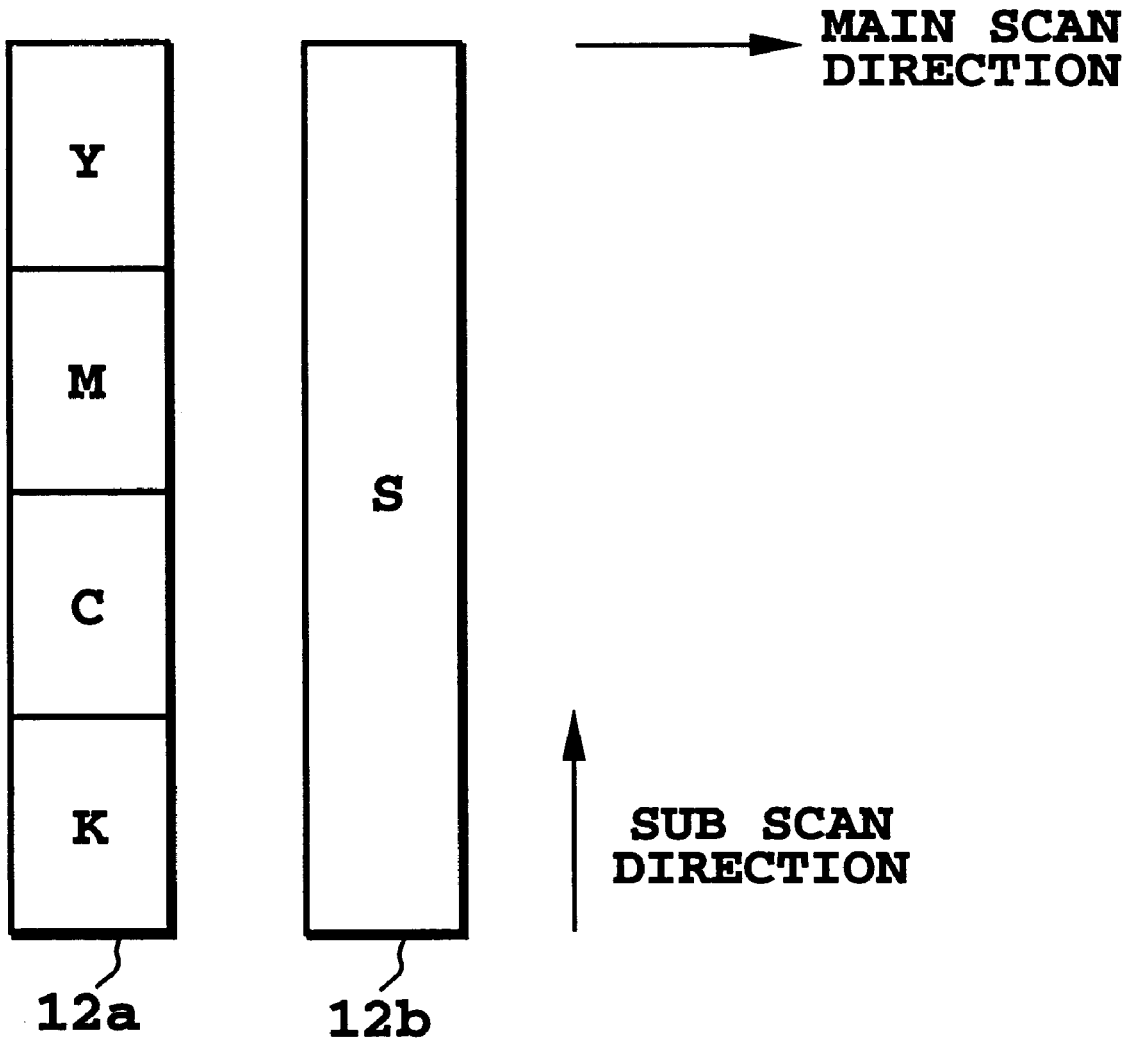
FIG. 5 is a plan view showing still another example of arrangement of the ink jet print heads with different colors installed in the ink jet printing apparatus of FIG. 1.

Further, the present invention may apply heads 12*a*, 12*b* as shown in FIG. 5. The head 12*a* is of a type in which nozzles of different colors are arranged in a single line, almost like the heads 12 of FIG. 4. The head 12*b* is dedicated for the processing liquid. This head configuration is suited for cases where a large amount of processing liquid is used as when the processing liquid is ejected over the entire surface of the print material.

(Embodiment 2)

Unlike the previous embodiment, the second embodiment is characterized in that the latent image is made visible by applying inks using an ink spray or an ink-soaked cloth, paper, writing brush and paintbrush.

A recorded medium, before its latent image is made visible, may be immersed in inks in containers to cause reaction between the processing liquid and the inks. Then, the recorded medium is exposed to running water or standing water to wash away inks that are not made insoluble by the processing liquid, thereby making the latent image visible.

This embodiment allows easy recovery of latent images in a visible form even when a user, after making recorded medium with latent images, sends them to other user who does not have a printing apparatus for applying inks to the media, because the latent image can easily be made visible simply by immersing the recorded medium in inks.

(Embodiment 3)

In the third embodiment, latent images are formed on a recording medium by applying a processing liquid with a writing brush or pen and are made visible by applying ink to the recorded medium by the printing apparatus.

This embodiment allows the user to make latent images with his or her own handwriting and also the user who does not have a printing apparatus to do so.

Here, as an example, the processing liquid or solution for making ink dyestuff insoluble can be obtained in the following manner.

Specifically, after the following components are mixed together and dissolved, and the mixture is pressure-filtered by using a membrane filter of 0.22 $\mu$m in pore size (tradename: fuloropore filter produced by Sumitomo Electric Industries, Ltd.), and thereafter, pH of the mixture is adjusted to a level of 4.8 by adding sodium hydroxide whereby processing liquid S can be obtained.

[components of S]

| | |
|---|---|
| low molecular weight ingredients of cationic compound; | 2.0 parts by weight |
| stearyl-trimethyl ammonium salts (tradename : Electrostriper QE, produced by Kao Corporation), or | |
| stearyl-trimethyl ammonium chloride (tradename : Yutamine 86P, produced by Kao Corporation) | |
| high molecular weight ingredients of cationic compound; | 3.0 parts by weight |
| copolymer of diarylamine hydrochloride and sulfur dioxide (having an average molecular weight of 5000) (tradename : polyaminesulfon PAS-92, produced by Nitto Boseki Co., Ltd.) | |
| thiodiglycol; | 10 parts by weight |
| water | balance |

Preferable examples of ink which becomes insoluble by mixing the aforementioned processing liquid can be noted below.

Specifically, the following components are mixed together, the resultant mixture is pressure-filtered with the use of a membrane filter of 0.22 $\mu$m in pore size (tradename: Fuloroporefilter, produced by Sumitomo Electric Industries, Ltd.) so that yellow ink Y1, magenta ink M1, cyan ink C1 and black ink K1 can be obtained.

[Yellow ink Y1]

| | |
|---|---|
| C. I. direct yellow 142 | 2 parts by weight |
| thiodiglycol | 10 parts by weight |
| acetylenol EH (tradename produced by Kawaken Fine Chemical Co., Ltd.) | 0.05 parts by weight |
| water | balance |

[Magenta ink M1]

having the same composition as that of Y1 other than that the dyestuff is changed to 2.5 parts by weight of C. I. acid red 289.

[Cyan ink C1]

having the same composition as that of Y1 other than that the dyestuff is changed to 2.5 parts by weight of acid blue 9.

[Black ink K1]

having the same composition as that of Y1 other than that the dyestuff is changed to 3 parts by weight of C. I. food black 2.

According to the present invention, the aforementioned processing liquid and ink are mixed with each other at the position on the printing medium or at the position where they penetrate in the printing medium. As a result, the ingredient having a low molecular weight or cationic oligomer among the cationic material contained in the processing liquid and the water soluble dye used in the ink having anionic radical are associated with each other by an ionic mutual function as a first stage of reaction whereby they are instantaneously separated from the solution liquid phase.

Next, since the associated material of the dyestuff and the cationic material having a low molecular weight or cationic oligomer are adsorbed by the ingredient having a high molecular weight contained in the processing liquid as a second stage of reaction, a size of the aggregated material of the dyestuff caused by the association is further increased, causing the aggregated material to hardly enter fibers of the printed material. As a result, only the liquid portion separated from the solid portion permeates into the printed paper, whereby both high print quality and a quick fixing property are obtained. At the same time, the aggregated material formed by the ingredient having a low molecular weight or the cationic oligomer of the cationic material and the anionic dye by way of the aforementioned mechanism, has increased viscosity. Thus, since the aggregated material does not move as the liquid medium moves, ink dots adjacent to each other are formed by inks each having a different color at the time of forming a full colored image but they are not mixed with each other. Consequently, a malfunction such as bleeding does not occur. Furthermore, since the aggregated material is substantially water-insoluble, water resistibility of a formed image is complete. In addition, light resistibility of the formed image can be improved by the shielding effect of polymer.

By the way, the term "insoluble" or "aggregation" refers to observable events in only the above first stage or in both the first and second stages.

When the present invention is carried out, since there is no need of using the cationic material having a high molecular weight and polyvalent metallic salts like the prior art or even though there is need of using them, it is sufficient that they are assistantly used to improve an effect of the present invention, a quantity of usage of them can be minimized. As a result, the fact that there is no reduction of a property of color exhibition that is a problem in the case that an effect of water resistibility is asked for by using the conventional cationic high molecular weight material and the polyvalent metallic salts can be noted as another effect of the present invention.

With respect to a printing medium usable for carrying out the present invention, there is no specific restriction, so called plain paper such as copying paper, bond paper or the like conventionally used can preferably be used. Of course, coated paper specially prepared for ink jet printing and OHP transparent film are preferably used. In addition, ordinary high quality paper and bright coated paper can preferably be used.

Ink usable for carrying out the present invention should not be limited only to dyestuff ink, and pigment ink having pigment dispersed therein can also be used. Any type of processing liquid can be used, provided that pigment is aggregated with it. The following pigment ink can be noted as an example of pigment ink adapted to cause aggregation by mixing with the treatment liquid S previously discussed. As mentioned below, yellow ink Y2, magenta ink M2, cyan ink C2 and black ink K2 each containing pigment and anionic compound can be obtained.

[Black ink K2]

The following materials are poured in a batch type vertical sand mill (produced by Aimex Co.), glass beads each having a diameter of 1 mm is filled as media using anion based high molecular weight material P-1 (aqueous solution containing a solid ingredient of styrene methacrylic acid ethylacrylate of 20% having an acid value of 400 and average: molecular weight of 6000, neutralizing agent potassium hydroxide) as dispersing agent to conduct dispersion treatment for three hours while water-cooling the sand mill. After completion of dispersion, the resultant mixture has a viscosity of 9 cps and pH of 10.0. The dispersing liquid is poured in a centrifugal separator to remove coarse particles, and a carbon black dispersing element having a weight-average grain size of 10 nm is produced.

(Composition of carbon black dispersing element)

| | |
|---|---|
| P-1 aqueous solution (solid ingredient of 20%) | 40 parts |
| carbon black Mogul L (tradename: produced by Cablack Co.) | 24 parts |
| glycerin | 15 parts |
| ethylene glycol monobutyl ether | 0.5 parts |
| isopropyl alcohol | 3 parts |
| water | 135 parts |

Next, the thus obtained dispersing element is sufficiently dispersed in water, and black ink K2 containing pigment for ink jet printing is obtained. The final product has a solid ingredient of about 10%.

[Yellow ink Y2]

Anionic high molecular P-2 (aqueous solution containing a solid ingredient of 20% of stylen-acrlylic acid methyl methaacrylate having an acid value of 280 and an average molecular weight of 11,000, neutralizing agent: diethanolamine) is used as a dispersing agent and dispersive treatment is conducted in the same manner as production of the black ink K2 whereby yellow color dispersing element having a weight-average grain size of 103 nm is produced.

(composition of yellow dispersing element)

| | |
|---|---|
| P-2 aqueous solution (having a solid ingredient of 20%) | 35 parts |
| C. I. pigment yellow 180 (tradename: Nobapalm yellow PH-G, produced by Hoechst Aktiengesellschaft) | 24 parts |
| triethylen glycol | 10 parts |
| diethylenglycol | 10 parts |
| ethylene glycol monobutylether | 1.0 parts |
| isopropyl alcohol | 0.5 parts |
| water | 135 parts |

The thus obtained yellow dispersing element is sufficiently dispersed in water to obtain yellow ink Y2 for ink jet printing and having pigment contained therein. The final product of ink contains a solid ingredient of about 10%.

[Cyan ink C2]

Cyan colored-dispersant element having a weight-average grain size of 120 nm is produced by using the anionic high molecular P-1 used when producing the black ink K2 as dispersing agent, and moreover, using the following materials by conducting dispersing treatment in the same manner as the carbon black dispersing element.

(composition of cyan colored-dispersing element)

| | |
|---|---|
| P-1 aqueous solution (having solid ingredient of 20%) | 30 parts |
| C. I. pigment blue 153 (tradename: Fastogen blue FGF, produced by Dainippon Ink And Chemicals, Inc.) | 24 parts |
| glycerin | 15 parts |
| diethylenglycol monobutylether | 0.5 parts |
| isopropyl alcohol | 3 parts |
| water | 135 parts |

The thus obtained cyan colored dispersing element is sufficiently stirred to obtain cyan ink C2 for ink jet printing and having pigment contained therein. The final product of ink has a solid ingredient of about 9.6%.

[Magenta ink M2]

Magenta color dispersing element having a weight-average grain size of 115 nm is produced by using the anionic high molecular P-1 used when producing the black ink K2 as dispersing agent, and moreover, using the following materials in the same manner as that in the case of the carbon black dispersing agent.

(composition of the magenta colored dispersing element)

| | |
|---|---|
| P-1 aqueous solution (having a solid ingredient of 20%) | 20 parts |
| C. I. pigment red 122 (produced by Dainippon Ink And Chemicals, Inc.) | 24 parts |
| glycerin | 15 parts |
| isopropyl alcohol | 3 parts |
| water | 135 parts |

Magenta ink M2 for ink jet printing and having pigment contained therein is obtained by sufficiently dispersing the magenta colored dispersing element in water. The final product of ink has a solid ingredient of about 9.2%.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

Figure 6:
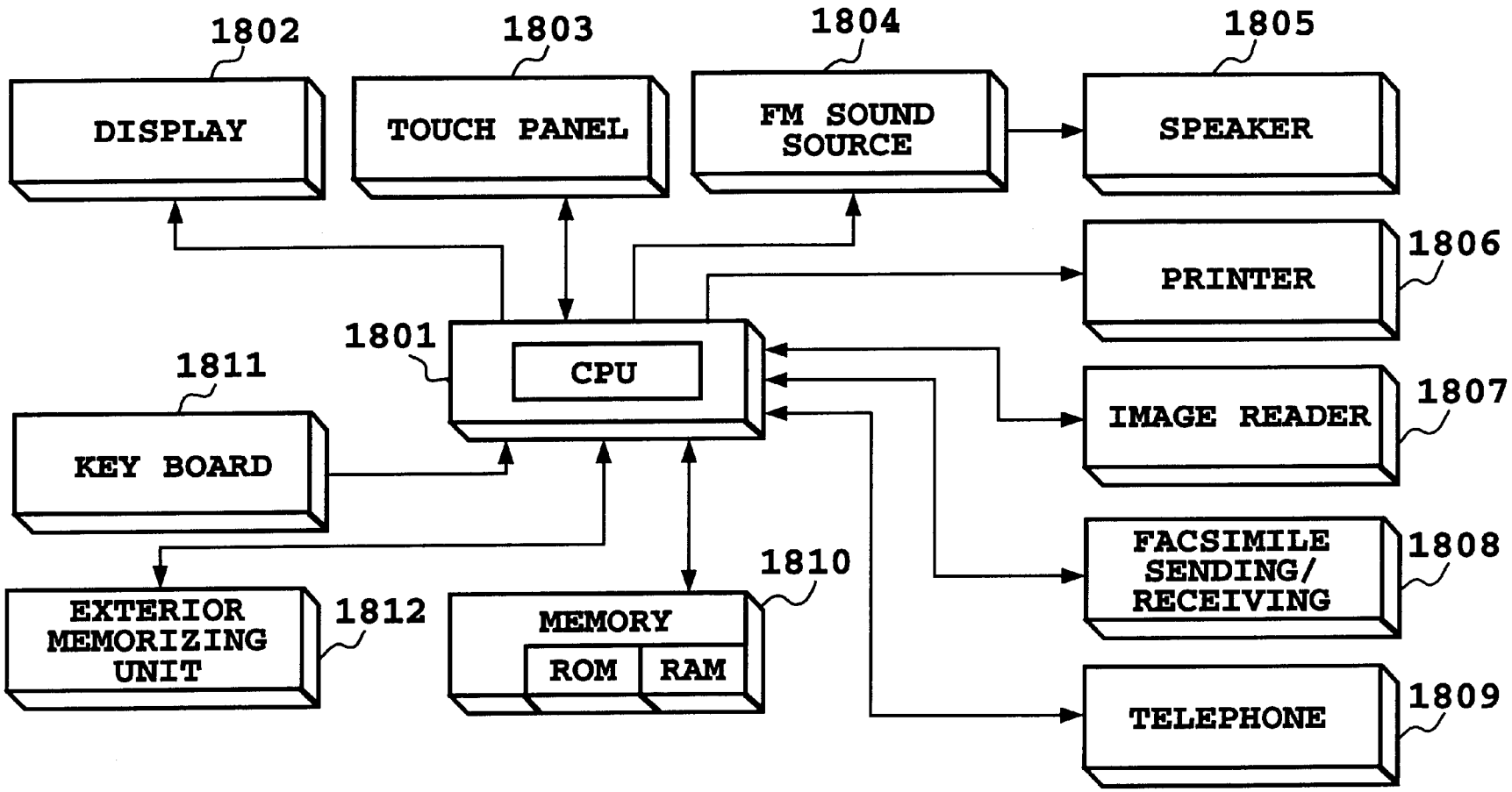
FIG. 6 is a block diagram showing an outline configuration of an information processing device with functions of a word processor, a personal computer, a facsimile and a copying machine, to which the ink jet printing apparatus according to the present invention is applied.

FIG. 6 is a block diagram showing general construction of an information processing apparatus having a function of wordprocessor, personal computer, facsimile machine, a copy machine and so forth, to which the printing apparatus according to the present invention is applied.

In the drawings, a reference numeral 1801 denotes a control portion performing control of the overall apparatus, which includes CPU, such as microprocessor and so forth, and various I/O port, to perform control for outputting control signal or data signal and so forth to respective portions and inputting control signal or data signal from the respective portions. A reference numeral 1802 denotes a display portion having a display screen, on which various menu, document information and image or so forth read by an image reader 1807 are displayed. A reference numeral 1803 denotes a transparent pressure sensitive touch panel provided on the display portion 1802 for performing item entry or coordinate portion entry on the display portion 1802 by depressing the surface thereof by a finger or so forth.

A reference numeral 1804 denotes an (frequency modulation) sound source portion which stores music information produced by a music editor and so forth in a memory portion 1810 or an external memory 1812 and performs FM modulation by reading out the stored music information from the memory portion or so forth. An electric signal from the FM sound source portion 1804 is transformed into an audible sound by a speaker portion 1805. A printer as a printing apparatus portion 1806 is employed as an output terminal of the wordprocessor, the personal computer, the facsimile machine, the copy machine and so forth, in which the printing apparatus according to the present invention is applied.

A reference numeral 1807 denotes an image reader portion for optoelectrically reading out an original data for inputting, which is located at the intermediate position in an original feeding path and performs reading out various original document, such as original document for facsimile machine or copy machine. A reference numeral 1808 denotes a facsimile (FAX) transmission and reception portion for transmitting original data read by the image reader portion or for receiving transmitted facsimile signal, which facsimile transmission and reception portion has an external interface function. A reference numeral 1809 denotes a telephone machine portion having a normal telephone function and various associated functions, such as a recording telephone and so forth.

A reference numeral 1810 denotes a memory portion including a ROM storing a system program, a manager program, other application program and so forth, as well as character fonts, dictionary and so forth, a RAM for storing application program loaded from an exterior memorizing unit 1812, document information, video information and so forth.

A reference numeral 1811 denotes a keyboard portion inputting document information or various commands. A reference numeral 1812 denotes the exterior memorizing unit employing a floppy disc or hard disc drive as storage medium. In the exterior memorizing unit 1812, document information, music or speech information, application program of the user and so forth are stored.

Figure 7:
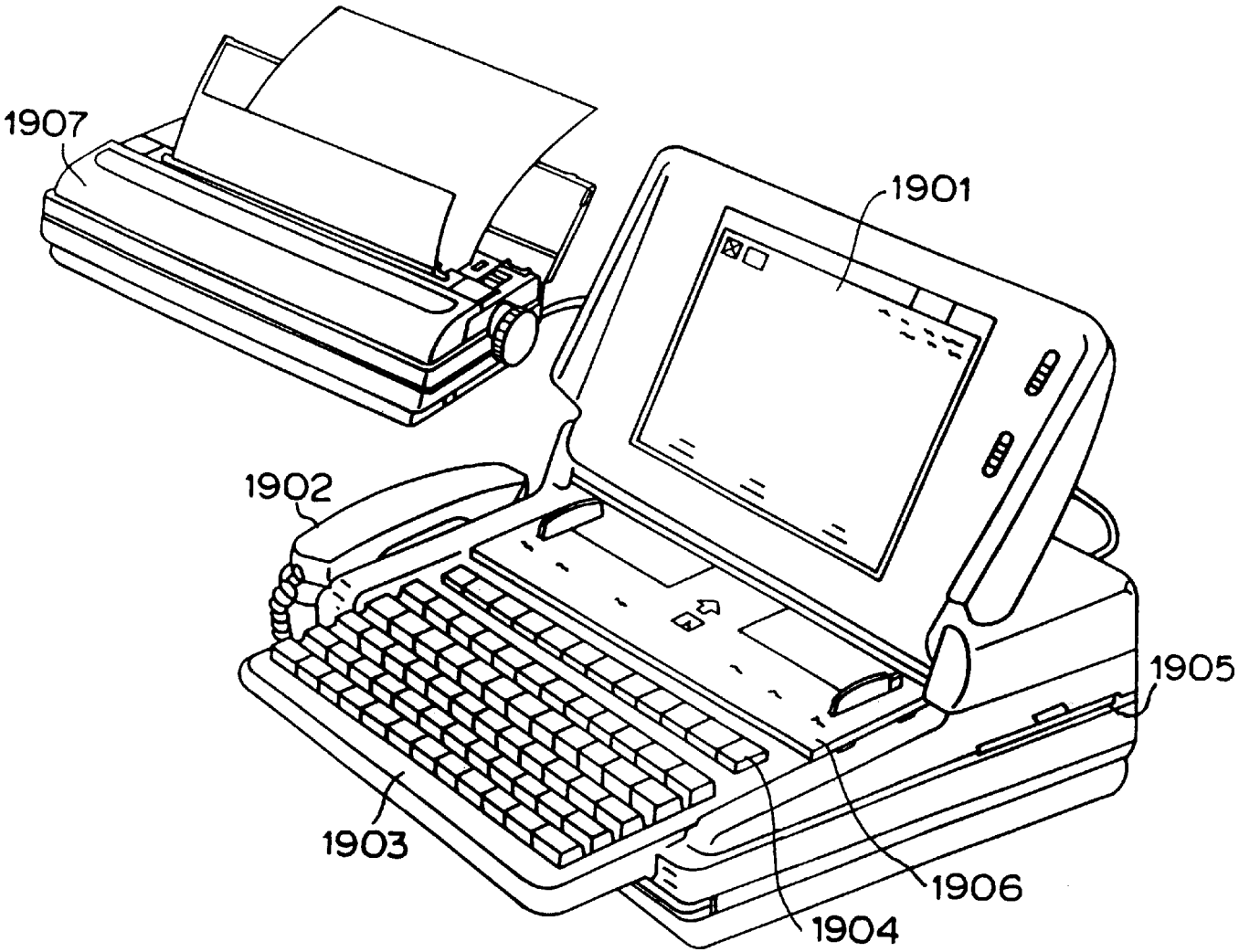
FIG. 7 is a schematic external view of the information processing device of FIG. 6.

FIG. 7 is a diagrammatic external view of the information processing system shown in FIG. 6.

In FIG. 7, a reference numeral 1901 denotes a flat panel display utilizing a liquid crystal and so forth. On this display, the touch panel 1803 is overlaid so that coordinate position input or item designation input can be performed by depressing the surface of the touch panel 1803 by a finger or so forth. A reference numeral 1902 denotes a handset to be used when a function as the telephone machine of the apparatus is used. A keyboard is detachably connected to a main body of the apparatus through a cable and adapted to permit entry of various document information or various data input. On the other hand, on the keyboard 1903, various function keys and so forth are arranged. A reference numeral 1905 denotes an insertion mouth of the external storage device 1812 for accommodating a floppy disk inserted thereinto.

A reference numeral 1906 denotes a paper stacking portion for stacking the original to be read by the image reader portion 1807. The original read by the image reader portion is discharged from the back portion of the apparatus. On the other hand, in facsimile reception, the received information is printed by the ink jet printing apparatus 1907.

It should be noted that while the display portion 1802 may be a CRT, it is desirable to employ a flat display panel, such as a liquid crystal display employing a ferrodielectric liquid crystal for capability of down-sizing and reduction of thickness as well as reduction of weight.

When the information processing apparatus as set forth apparatus is operated as the personal computer or the wordprocessor, various information input through the keyboard portion 1811 is processed according to a predetermined program by the control portion 1801 and output as printed image by the printing apparatus portion 1806.

When the information processing apparatus is operated as a receiver of the facsimile machine, facsimile information input from the FAX transmission and reception portion 1808 via a communication network is subject to reception process according to the predetermined program and output as received image by the printing apparatus portion 1808.

In addition, when the information processing apparatus is operated as a copy machine, the original is read by the image reader portion 1807 and the read original data is output to the printing apparatus portion as copy image via the control portion 1801. It should be noted that, when the information processing apparatus is used as the transmitter of the facsimile machine, the original data read by the image reader 1807 is processed for transmission according to the predetermined program by the control portion, and thereafter transmitted to the communication network via the FAX transmission and reception portion 1808.

Figure 8:
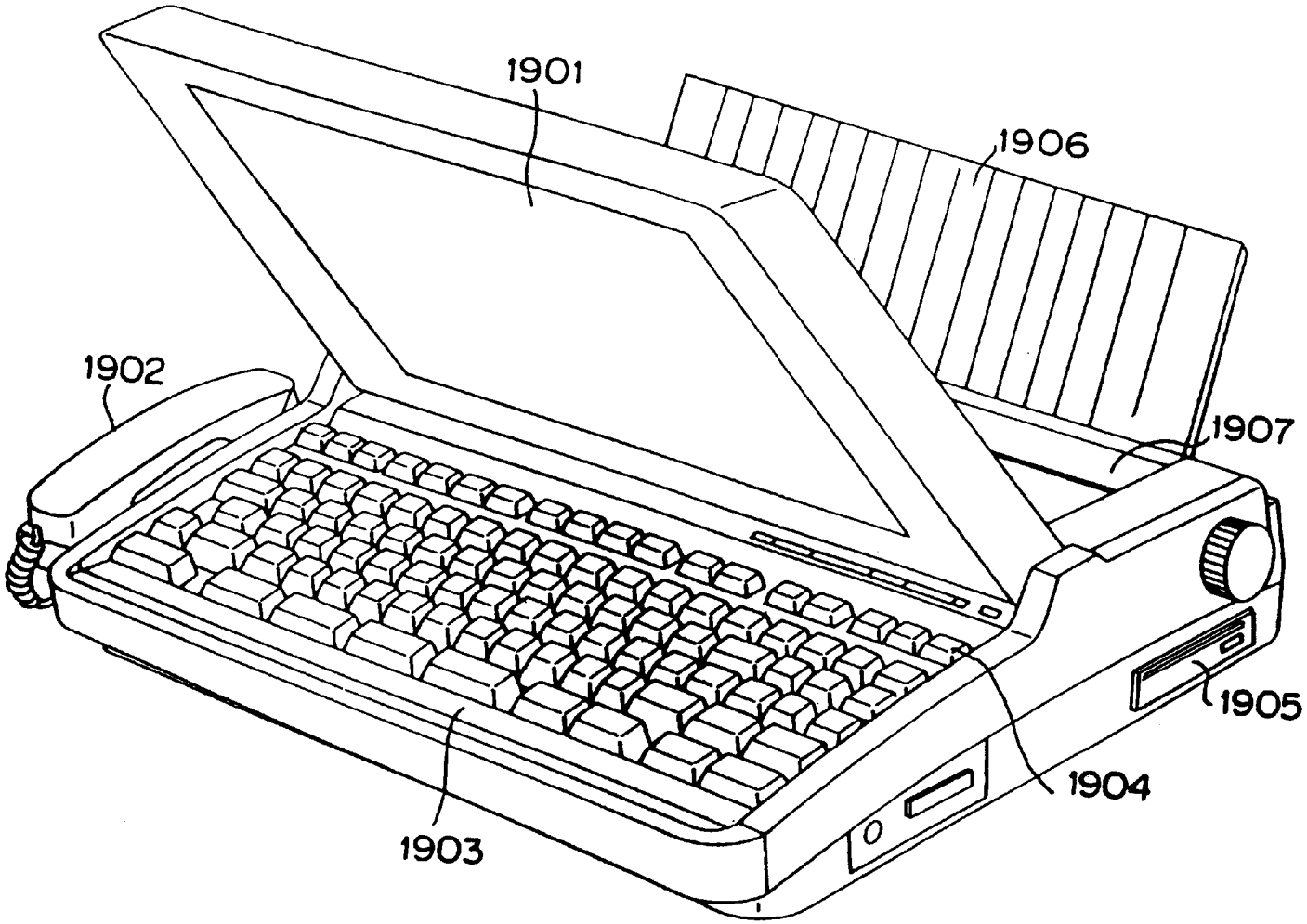
FIG. 8 is a schematic external view showing an example of the ink jet printing apparatus as applied to the information processing device.

It should be noted that the information processing apparatus may be an integrated type incorporating the ink jet printing apparatus within a main body as illustrated in FIG. 8. In this case, portability can be further improved. In FIG. 8, the portions having the same function to FIG. 7 are shown with the corresponding reference numerals.

As set forth above, a multi-function type information processing apparatus may obtain high quality printed image at high speed and low noise by employing the printing apparatus of the present invention. Therefore, the functions of the information processing apparatus can be further enhanced.

As described above, this invention creates latent images on recording paper by applying to the paper an almost colorless liquid to make colorant of ink insoluble or coagulate, and then renders the latent images visible by simply applying ink to the recorded paper. Thus, with this invention the user can readily enjoy making hidden messages or pictures visible with the ink jet system as you would with the conventional Japanese technique of "aburidashi."

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing method, comprising the steps of:

applying to a print material a substantially colorless liquid containing a substance that makes colorant of ink insoluble or coagulate to form an invisible latent image on the print material based on image data;

applying the ink to at least a part of the latent image formed on the print material and to at least a part of the print material other than where the latent image is formed; and removing only the part of the ink applied in the ink application step to the print material which is not insoluble or coagulated and is other than ink made insoluble or coagulated by the substance contained in the liquid that makes the colorant of the ink insoluble or coagulate and thereby revealing in an image form the latent image so that the latent image is made visible on the print material, wherein the ink is a water-soluble ink and wherein said ink removing step is performed by exposing the printing material to running water or standing water.

2. An ink jet printing method as claimed in claim 1, wherein said liquid applying step is performed so as to obtain a specific ratio of optical density of an optical density value $OD_1$ of an area where the latent image is made visible to an optical density value $OD_2$ of an area removed of ink that is not made insoluble or coagulated so as to satisfy the following expression:

$$2 \leqq OD_1 : OD_2.$$

3. An ink jet printing method as claimed in claim 1, wherein said liquid applying step is performed so as to obtain a specific ratio of optical density of an optical density value $OD_1$ of an area where the latent image is made visible to an optical density value $OD_2$ of an area removed of ink that is not made insoluble or coagulated so as to satisfy the following expression:

$$3 \leqq OD_1 : OD_2.$$

4. An ink jet printing method as claimed in claim 1, wherein the ink removing step is performed by wiping ink from the print material.

5. An ink jet printing method as claimed in claim 1, wherein the application of the liquid or the ink is performed by an ink jet type ejection means.

6. An ink jet printing method as claimed in claim 51, wherein the ejection means includes an ejection energy generating element to produce energy to eject the liquid or the ink.

7. An ink jet printing method as claimed in claim 6, wherein the ejection energy generating element is an electrothermal transducer to generate thermal energy to cause film boiling in the liquid or the ink.

8. An ink jet printing method as claimed in claim 1, wherein the liquid includes low molecular weight cation substances and high molecular weight cation substances having higher molecular weights than those of the low molecular weight cation substances, and the ink includes anion dyes.

9. An ink jet printing method as claimed in claim 1, wherein the liquid includes low molecular weight cation substances and high molecular weight cation substances having higher molecular weights than those of the low molecular weight cation substances, and the ink includes at least anion compounds and pigments.

10. An ink jet printing method, comprising the steps of:

providing a print material with a surface having an invisible latent image formed by applying to a liquid application area a substantially colorless liquid containing a substance that makes colorant of a color ink insoluble or coagulate on the print material based on image data;

applying the color ink to the liquid application area of the print material formed in said providing step and to a part of the print material other than the liquid application area of the print material; and removing from the print material only that part of the color ink which is not insoluble or coagulated and is other than ink made insoluble or coagulated by the substance that makes the colorant of the ink insoluble or coagulate contained in the liquid applied to the liquid application area of the print material, to reveal in an image form a latent image corresponding to the liquid application area to make the latent image visible on the print material, wherein the ink is a water-soluble ink and wherein the ink removing step is performed by exposing the print material to running water or standing water.

11. An ink jet printing method as claimed in claim 10, wherein the color ink application step is performed before the liquid application step.

12. An ink jet printing method as claimed in claim 10, wherein the liquid includes low molecular weight cation substances and high molecular weight cation substances having higher molecular weights than those of the low molecular weight cation substances, and the ink includes anion dyes.

13. An ink jet printing method as claimed in claim 10, wherein the liquid includes low molecular weight cation substances and high molecular weight cation substances having higher molecular weights than those of the low molecular weight cation substances, and the ink includes at least anion compounds and pigments.

14. An ink jet printing apparatus, comprising:

first ejecting means for ejecting a substantially colorless liquid containing a substance that makes colorant of a water-soluble ink insoluble or coagulate within a predetermined area of a print material based on image signals so as to form an invisible latent image of only the liquid within the predetermined area of the print material;

second ejecting means for ejecting the ink onto a substantially entire surface of the predetermined area of the print material; and driving means for selectively driving the first ejecting means or the second ejecting means according to operator instructions, wherein the latent image is revealed in an image form so that the latent image is made visible by exposing the predetermined area of the print material to running water or standing water for removing the ink of which the colorant is not insoluble or coagulated.

* * * * *

UNITED STATES PATENT AND TRADEMARK OFFICE

CERTIFICATE OF CORRECTION

PATENT NO. : 6084,621
DATED : July 4, 2000
INVENTOR(S) : Shioya

It is certified that error appears in the above-identified patent and that said Letters Patent is hereby corrected as shown below:

In the Drawings,
Sheet 6, Figure 6, "KEY BOARD" should read -- KEYBOARD --.

Column 1,
Line 43, "for" should read -- to --.

Column 3,
Line 51, "for" should read -- to --.

Column 4,
Line 59, "generates" should read -- generate --.

Column 9,
Line 29, "so" should read -- so- --.
Line 53, "average:" should read -- average --, and "agent" should read -- agent: --.

Column 11,
Line 22, "is" should read -- are --.

Column 13,
Line 20, "an" should read -- an FM --.
Line 37, "document," should read -- documents, --, and "document" should read -- documents --.
Line 41, "signal," should read -- signals, --.
Line 49, "program" should read -- programs --.
Line 51, "program" should read -- programs --.
Line 60, "gram" should read -- grams --.

UNITED STATES PATENT AND TRADEMARK OFFICE

CERTIFICATE OF CORRECTION

PATENT NO. : 6,084,621
DATED : July 4, 2000
INVENTOR(S) : Shioya

It is certified that error appears in the above-identified patent and that said Letters Patent is hereby corrected as shown below:

Column 14,
Line 36, "copy" should read -- a copy --.
Line 51, "high" should read -- a high --.

Column 15,
Line 51, "claim 51," should read -- claim 5, --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*